United States Patent [19]

Stille

[11] Patent Number: 4,666,155

[45] Date of Patent: May 19, 1987

[54] ARTIFICIAL PITCHING PAD

[76] Inventor: Harry Stille, P.O. Box 203, Due West, S.C. 29639

[21] Appl. No.: 697,968

[22] Filed: Feb. 4, 1985

[51] Int. Cl.[4] ..... A63B 71/00

[52] U.S. Cl. ..... 273/25; 273/DIG. 8

[58] Field of Search ..... 273/25, 26 R

[56] References Cited

U.S. PATENT DOCUMENTS

| | | | |
|---|---|---|---|
| 3,169,022 | 2/1965 | Kretsinger | 273/26 R |
| 3,479,028 | 11/1969 | Goeders | 273/25 |
| 3,837,646 | 9/1974 | Goeders | 273/25 |
| 4,063,729 | 12/1977 | Holloway | 273/25 |
| 4,306,718 | 12/1981 | Goeders | 273/25 |

*Primary Examiner*—Richard C. Pinkham
*Assistant Examiner*—T. Brown
*Attorney, Agent, or Firm*—Cort Flint

[57] ABSTRACT

An artificial pitching pad device (A) is disclosed for being implanted in a natural pitcher's mound constructed or earthen material which includes a rigid base member (B) and a resilient friction pad (C) embedded within the base member having a contoured artificial pitching surface (18). A raised rear support pitching surface (20) is formed at a rear of the device and terminates in a depressed ledge (22) which receives a pitching abutment block (24). A lower pitching support surface (40) is disclosed below the raised rear support surface (20). The lower support surface includes a foot support surface (42) for receiving the foot of a pitcher abutting against the pitching block (24) in a pitching stance. The lower pitching support surface further includes a runway surface (48) of the resilient friction material which accommodates full movement of the pitcher after delivery. An anchor bore passage (52, 54) is included in the friction pad and base member for receiving a spike 56 for securing the pitcher's block and artificial pad together, as well as securing the same into the earthen material.

13 Claims, 4 Drawing Figures

ARTIFICIAL PITCHING PAD

BACKGROUND OF THE INVENTION

The invention relates to the provision of a pitching pad device having an artificial surface which can be used outdoors in combination with a conventional pitcher's mound constructed from earthen material to provide an artificial pitching surface. The pitching surface of a natural pitching mound constructed from earthen material requires landscape maintenance and grooming to keep it in a safe condition and in compliance with pitching regulations. The cost and effort required can be justified for major playing fields. However, for parks, practice fields, and other minor playing fields, maintenance and grooming of the pitching mound and surface often goes undone. A deep hole is dug in front of the pitcher's rubber which can become dangerous and result in ankle or foot injury. The eroding of an unkept pitching mound surface causes noncompliance with the specifications established by baseball regulations. Even for major playing fields, the cost and effort required to maintain the pitching mound is inordinate.

Heretofore, numerous devices have been proposed as artificial pitching mounds which consists generally of a raised or concave shell upon which a pitcher stands for pitching. These devices are mainly for indoor use. The primary purpose of the rigid concave shell is to replace the earthen mound used outdoors. Thus, these devices are in the truest sense of the word an artificial pitching mound. While these devices are suitable for limited purposes outdoors, they are not suitable for providing an artificial pitching surface in combination with a natural dirt pitching mound.

Examples of the afore described artificial pitching mounds used in lieu of a natural pitching mound are disclosed in U.S. Pat. Nos. 3,479,028; 3,837,646; and 4,063,729.

Accordingly, an important object of the present invention is to provide a pitching pad device having an artificial pitching surface which can be implanted in a natural pitching mound constructed from earthen material to provide an artificial pitching surface and eliminate the need of expensive landscape maintenance and grooming.

Still another important object of the present invention is to provide an artificial pitching pad device having a resilient pitching surface which is encapsulated for rigidity and stability so that it is durable and reliable for implantation in the earthen material of a natural pitching mound.

Still another important object of the present invention is to provide an artificial pitching pad device having a resilient pitching surface which can be used with a conventional pitcher's rubber in such a manner that the pitcher's rubber and the pad device can be anchored in earthen material.

Still another important object of the present invention is to provide an aritifical pitching pad having a resilient friction pitching surface which is inexpensive, lightweight, and durable, and can be used in outdoor baseball fields and parks with little or no landscape maintenance or grooming, yet a pitching mound surface is provided which is always in a safe condition and within the specifications of baseball regulations.

SUMMARY OF THE INVENTION

The above objectives are accomplished according to the present invention by providing an artificial pitching pad device which can be implanted and used with a natural pitching mound constructed from earthen material. The device comprises a general rigid base member having an open interior defined by a base surface and an outer integral rim extending upwardly and around the outer limits of the base surface. The outer rim of the base surface has a sufficient height to provide an outer wall coverable by the earthen material to implant the base member in a natural pitching mound. An artificial pitching surface constructed as a contoured pad of a resilient material is embedded within the hollow interior of the rigid base member. The surface of the resilient friction pad projects above the outer rim a predetermined distance so that the pitching surface is generally flush with or above the earthen material. An artificial contoured pitching surface is provided having an extent which accommodates movement of a complete pitching exercise thereon. A depressed ledge is formed in the contoured pitching surface so that a conventional pitching abutment block, or pitcher's rubber, may be received and contained therein. Spike receiving anchor passages are formed in the depressed ledge of the pitching surface so that the spikes of the pitching rubber may pass through the artificial pitching pad device and be anchored in the earthen material. In this manner, the pitcher's rubber and the pitching pad device are secured in place and anchored in the earthen pitching mound.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 2:
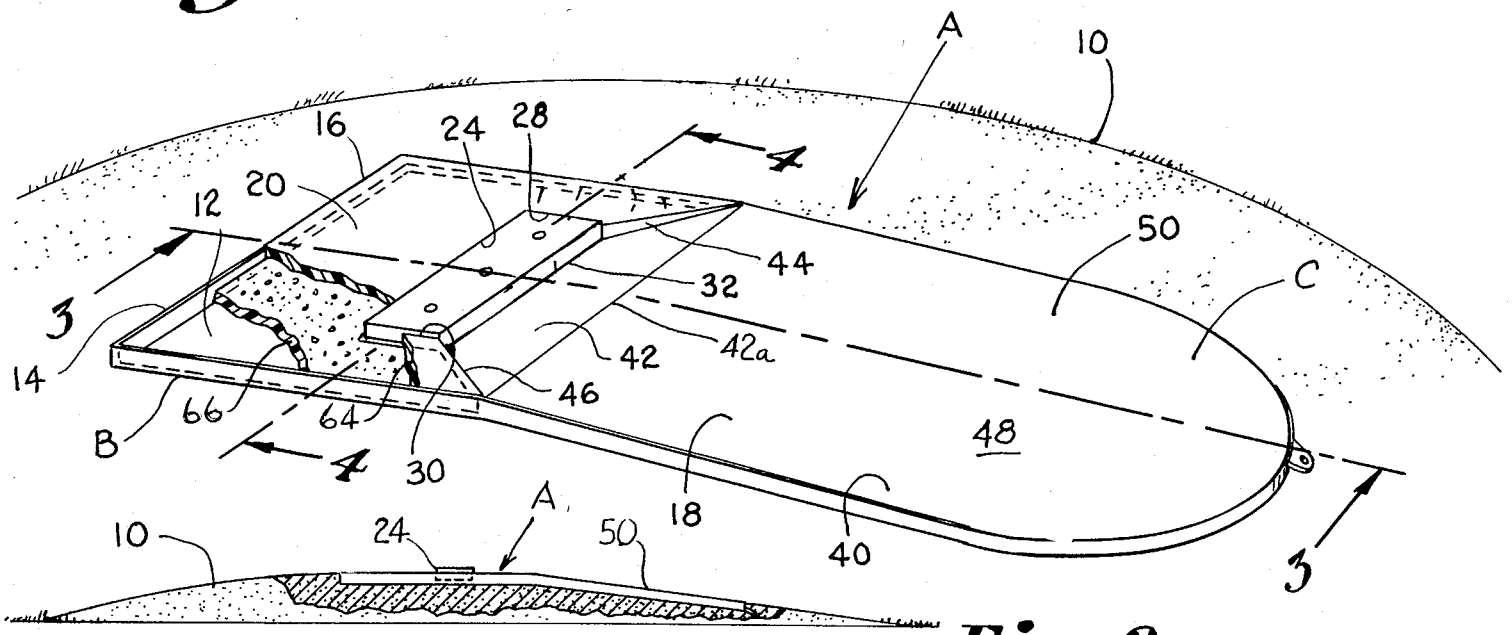
FIG. 1 is a perspective view illustrating an artificial pad device constructed according to the present invention.
FIG. 2 is a sectional view illustrating an artificial pitching pad device constructed in accordance with the present invention implanted in a natural earth pitching mound.

Referring now in more detail to the drawings, an artificial pitching pad device, designated generally as A, is illustrated which is implanted in a natural pitching mound 10 constructed from earthen material in an outdoor baseball field. The artificial pitching pad device A includes a rigid base member B and an artificial resilient friction pad C which is embedded in the base member B.

The base member B is preferably constructed from a fiberglass material and includes a rigid base surface 12 and an outer rim 14 integral with the base surface which extends vertically and defines the outer limits of the base surface. The outer rim terminates in an upper free edge 16 around the perimeter of the base member. The integral pitching pad C has an outer, exposed, generally resilient contoured pitching surface 18 which is bounded by the outer rim 14 of the base member. The resilient pitching surface 18 projects above the upper free edge 16 of the outer rim a predetermined distance so that the device may be implanted with the base member B concealed and protected from contact by the earthen material 10. The outer resilient friction pitching surface 18 is then exposed for contact by the pitcher, shown in dotted lines as P, without danger of accidental contact with the rigid base. A generally flush artificial pitching surface is thus provided by the contoured surface 18 which would appear much like the dirt pitching surface of a natural pitching mound lying generally flush with the mound of earthen material.

Figure 3:
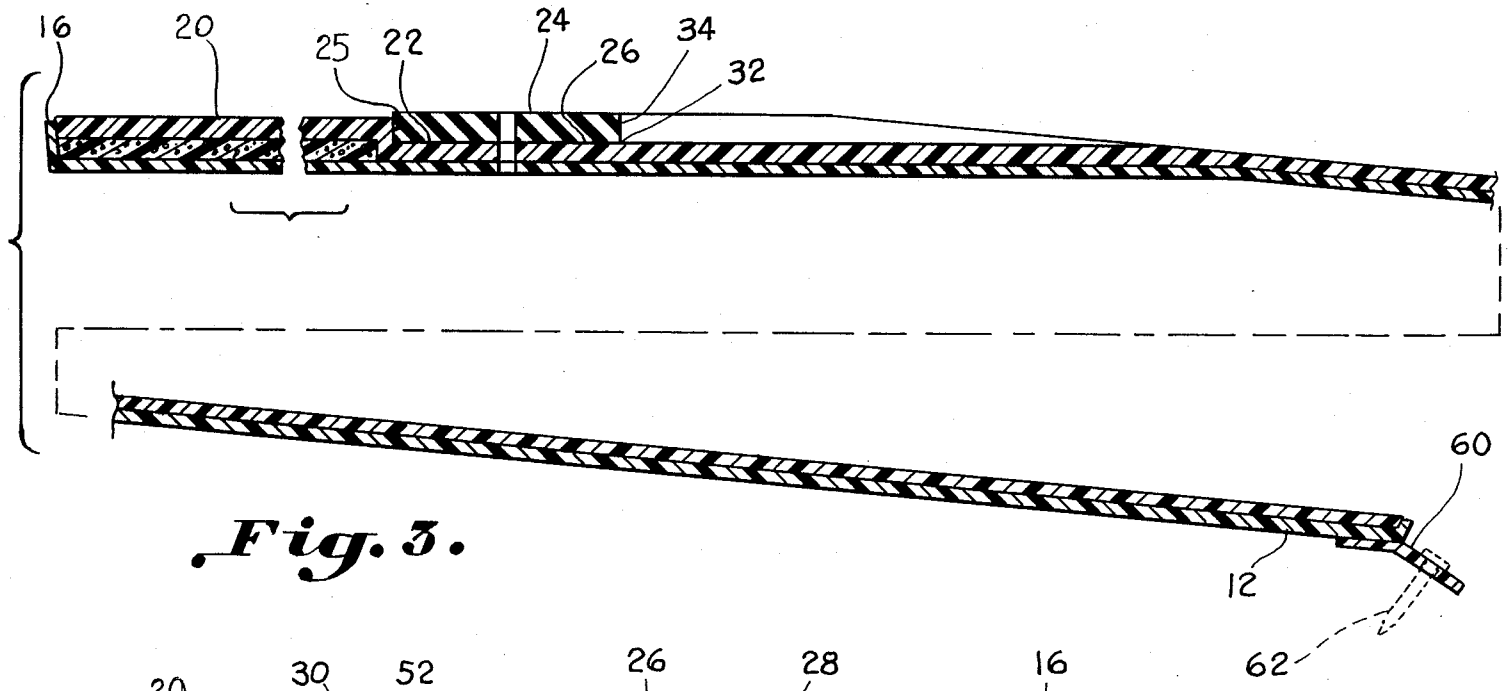
FIG. 3 is a section view taken along line 3—3 of FIG. 1.

Referring now in more detail to FIGS. 1 and 3, it can be seen that the artificial contoured pitching surface 18 of the pad C includes a raised rear support surface 20 at the back of the device for accommodating the pitcher while standing prior to the delivery of a pitch. A depressed ledge 22 is formed in the contoured pitching surface forward of the rear support surface 20 for accommodating a pitching abutment block 24 that is conventionally referred to as the pitching rubber. The depressed ledge 22 includes a rear vertical ledge wall 25 at which the raised support surface 20 is terminated. Wall 25 extends downwardly to a horizontal bottom surface 26 of the ledge. There is a pair of vertical side ledge walls 28 and 30 generally perpendicular to the rear ledge wall 24 and parallel to one another limiting the ends of the depressed ledge surface 26. The side ledge walls 28, 30 terminate at a front line 32 of the ledge. A foot abutment surface 34 is provided by a vertical wall of the pitching rubber 24 when inserted in place. It can be seen that the entire front wall 34 of the pitching rubber is available for contact with a foot of the pitcher when delivering the pitch, as can best be seen in FIG. 3.

The outer contoured pitching surface 18 further includes a lower generally planar support surface 40 which is below the raised support surface 20. The lower planar support surface 40 includes a planar horizontal foot support surface 42 formed in front of the front line 32 of the depressed ledge 22. The support surface 42 is for placement of the pitcher's foot against the pitching rubber at 34 during delivery. The width of the foot support surface 42 is limited by a pair of rear support wall surfaces 44 and 46 which extend from the side ledge walls 28, 30 and extend outwardly to the edges of the artificial pitching surface. It is noted that the rear support wall surfaces 44 and 46 diverge at an angle of 45° with respect to the front line 32 of the ledge 22. This provides a means for making a 45° line within which the pitcher must stay when making delivery to first base. The divergent walls 44 and 46 converge downwardly, generally to a flush relationship with the lower support surface 40 so that no obstacle is presented to the pitcher when moving on the resilient contoured pitching surface.

The lower support surface 40 further includes a pitching runway 48 extending from the forward edge 42*a* of the support surface 42 to the end of the pad device. The pitching runway 48 includes a downwardly sloping surface 50 which slopes slightly downwardly as can best be seen in FIG. 2, and has an extent to accommodate the forward movement of the pitcher after delivery.

Anchor means is provided for attaching the abutment block 24 to the pitching pad device A and for anchoring the abutment block and the pad in the earthen material of the pitching mound. The anchor means includes spike receiving anchor bore passages 52 and 54 formed in the artificial pad C and the rigid base 12 of the base member B in alignment. By this means, the pitching rubber 24 may be affixed in the depressed ledge 22 and secured therein by the conventional spikes 56 which hold the rubber in place in a natural pitching mound. The spikes 56 penetrate the pad device, and pass through pad device of the present invention, and penetrate the earthen material to anchor both the rubber and the pad device therein. As an additional result of affixing the pitching rubber to the pad by anchoring the same in the earthen material, the requirement of having the pitching rubber anchored in the dirt is met.

Further attachment means may be provided in the form of a attachment tab 60 which is adhered to the base 12 of the base member B at the forward end. A spike 62 may be received through an opening in the tab to further anchor the implanted artificial pad device in the dirt pitching mound as required. This may be necessary in some types of applications and soil to securely anchor the pitching pad device in place against repeated and heavy movement of the pitcher during delivery.

Figure 4:
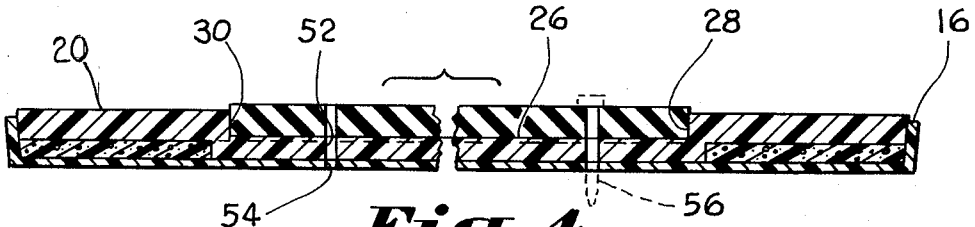
FIG. 4 is a section view taken along line 4—4 of FIG. 1.

As can best be seen in FIGS. 3 and 4, the artificial pitching pad C is constructed from a resilient, deformable material such as an elastomeric urethane material 64 to provide a contoured resilient pitching surface 18. A suitable material is an elastomeric urethane manufactured by Niggle Associates of Columbia, S.C., under the trademark Sportan which has a surface which is embossed to give a more natural feel and appearance. A generally rigid filler material is utilized at 66 in the rear support area 20 of the contoured pitching surface. The filler 66 may be any lightweight polymeric material strong enough for a filler. A cellular rigid urethane foam material is preferred. This gives a more lightweight, yet supportive, construction for the thicker rear section of the pad C. In practice, the urethane material 64 is one-half inch in thickness, and urethane foam 66 is five-eighths inch in thickness.

The base 12 is approximately one-eighth inch in thickness and outer wall 14 extends approximately one inch above the base so that pad C extends about one-eighth of an inch above the wall. The shallow base may be implanted and covered with the contoured pitching surface 18 generally flush with the surrounding turf. The distance from the back of the rear support surface 20 to the front line 42*a* of the foot support surface is approximately 34 inches. The pitching runway 50 is about six feet and has a slope of one inch per foot.

While a preferred embodiment of the invention has been described using specific terms, such description is for illustrative purposes only, and it is to be understood that changes and variations may be made without departing from the spirit or scope of the following claims.

What is claimed is:

1. In combination with a pitcher's mound constructed from earthen material, an artificial pitching pad device adapted for implantation in said earthen material comprising:

a generally rigid open top base member adapted for implanatation in said earthen material having a rigid base surface and an upwardly extending outer rim defining the outer limits of said base surface around the entire perimeter thereof;

said outer rim terminating in an upper free edge around the perimeter of said base member;

said open top generally hollow base member being contoured in a manner to follow the exterior contour of an earthen pitcher mound when implanted thereon;

an integral pitching pad constructed from a resilient friction material having an upper generally resilient contoured pitching surface said pitching pad member generally bounded by said outer rim of said base member and having a thickness which generally exceeds the height of said rim so that said impanted base member may be implanted in said earthen material in a concealed manner with said resilient pitching surface being exposed above ground for supporting said pitcher generally at ground level in a natural manner;

a planar rear support surface included in said resilient pitching surface;

a depressed ledge formed in said rear support surface for receiving and containing a pitching abutment block;

said depressed ledge including a rear wall terminating in a pair of side walls, each side wall extending forwardly from said rear wall and extending to a front line of said depressed ledge, a pair of rear support walls, each being joined to a said side wall at said front line and diverging outwards to the edge of said resilient pitching surface;

a foot supporting surface formed in said resilient contoured pitching surface adjacent and forward of said front line of said ledge for supporting a foot of a pitcher in a pitching position with said foot resting against a front wall of said pitching abutment block;

a runway support surface included in said resilient contoured pitching surface forward of said foot support surface for accommodating the full extent of forward movement of a pitcher following delivery of a pitch; and anchor means carried by said ledge means for affixing said pitching abutment block within said depressed ledge and simultaneously to said earthen material in which said base member is implanted.

2. The device of claim 1 including attachment means carried by said base a member for securing said base member to said earthen material when implanted therein.

3. The device of claim 1 wherein said depressed ledge defines the forward limit of said rear support surface.

4. The device of claim 1 wherein said resilient pitching pad is constructed from a urethane material.

5. The device of claim 4 wherein said pad includes a generally rigid lightweight foam urethane filling material intermediate said resilient surface of said rear support surface and said base surface of said base member.

6. The device of claim 1 wherein said anchor means includes spikes and spike receiving anchor bore passages extending through said material of said pitchers abutment block said pitching pad and said rigid material of said base member.

7. A pitching pad device having an artificial pitching surface with an extent accommodating full exercise of pitching movement comprising:

a generally rigid open top hollow outer base member;

an integral pitching surface pad having an outer resilient contoured pitching surface constructed from a friction material embedded within said outer base member and coextending over said open top of said base member;

a depressed ledge formed in said resilient contoured pitching surface, for receiving a pitching abutment block having the general shape and size of said depressed ledge and positioned therein;

planar support surface rearwardly of said depressed ledge on said resilient contoured pitching surface above said depressed ledge defining a rear standing surface for a pitcher prior to assuming a pitching position;

said depressed ledge including a rear vertical ledge wall terminating said raised planar support surface and extending downwardly therefrom to a horizontal bottom ledge surface;

a pair of vertical side ledge walls extending generally perpendicular to said rear ledge wall and parallel to one another determining the ends of said depressed ledge, said side ledge walls terminating at a front edge of said ledge button surface, a foot support surface forward of said front edge of said bottom ledge surface and said abutment block; said foot support surface including;

a pair of divergent side walls extending from said vertical side ledge walls and said bottom edge front edge and terminating at said side edges of said pitching surface pad, said diverging walls being inclined to said front edge of said bottom ledge at an angle of 45° to facilitate orientation of the pitcher during delivery to first or third base; and a pitching runway including a downwardly sloping surface extending from said foot support surface to a front edge of said contoured pitching surface accommodating full movement of the pitcher after delivery.

8. The device of claim 7 including anchor means formed in said depressed ledge for securing said pitching abutment block simultaneous to said pad device and said earthen material in which said device is implanted.

9. The device of claim 7 wherein said rearward planar support surface includes an outer layer of resilient urethane material an intermediate layer of cellular generally rigid foam urethane filler material, and a bottom rigid layer whereby a raised yet lightweight reinforced support surface is provided.

10. The device of claim 7 wherein said divergent side walls converge to a generally flush relationship with said sloped pitching runway surface to thereby merge said raised rear support surface and said lower pitching support surfaces smoothly with one another avoiding obstacles to a person moving upon said contoured pitching surface during pitching exercises.

11. In combination with a pitcher's mound constructed from earthen material, an artificial pitching pad device adapted for implantation into said earthen material comprising:

a generally hollow shell base member having an open interior defined by a base surface and an outer rim integral with said base surface extending upwardly around said base surface to define its outer extent;

said outer rim having a finite height which is below said earthen material in a concealed manner when said pitchers mound is in use;

an integral pitching pad constructed from a resilient friction material carried within said hollow interior of said base member and having a thickness which generally exceeds the height of said rim of said base member;

a resilient contoured pitching surface provided on said pad projecting above said outer rim a predetermined distance so that said contoured pitching surface is exposed above said earthen material to thereby afford an artificial pitching surface which generally follows the contour of said earthen pitching mound accommodating full and natural movement of a pitcher during the exercise of pitching:

a depressed ledge formed in said contoured pitching surface for accommodating placement of a pitching abutment block; and anchor means carried in said ledge for securing said pitching abutment block to said pad device and said earthen material simultaneously to thereby retain said pitching abutment block and said pad device in said implanted position.

12. The device of claim 11 wherein said hollow base includes a generally rigid fiberglass shell and said pitching pad is constructed from urethane material placed within said fiberglass shell.

13. The device of claim 12 including an intermediate layer of cellular generally rigid foam material positioned between at least a portion of said contoured pitching surface and said fiberglass shell.

* * * * *